US005765452A

United States Patent [19]

Roux et al.

[11] Patent Number: 5,765,452

[45] Date of Patent: Jun. 16, 1998

[54] METHOD FOR IMPROVING THE ENDURANCE OF A BLADE BASE OF A DISC CHIPPER, A BLADE BASE OF A DISC CHIPPER AND A DISC CHIPPER

[75] Inventors: Paul Roux, Trussville, Ala.; Timothy P. Nettles, Carthage, N.Y.; Hannu Tähkänen, Rauma, Finland; Arvo Jonkka, Pori, Finland; Pauli Vienola, Pori, Finland; Antti Tohkala, Pori, Finland

[73] Assignee: Sunds Defibrator Woodhandling OY, Pori, Finland

[21] Appl. No.: 775,295

[22] Filed: Dec. 31, 1996

[30] Foreign Application Priority Data

Jan. 22, 1996 [FI] Finland ..... 960298

[51] Int. Cl.[6] ..... B21K 5/00; B27C 1/00

[52] U.S. Cl. ..... 76/115; 72/53; 29/527.7; 76/DIG. 2; 144/162.1; 144/329; 144/176

[58] Field of Search ..... 144/162.1, 176, 144/329; 83/661, 835, 848; 72/53; 76/112, 115, 116, DIG. 2; 29/90.7, 527.7; 416/222 R; 148/322, 545, 610

[56] References Cited

U.S. PATENT DOCUMENTS

| | | | |
|---|---|---|---|
| 4,086,104 | 4/1978 | Kinoshita et al. | 72/53 X |
| 4,550,487 | 11/1985 | Itoshino et al. | 29/527.7 |
| 5,098,231 | 3/1992 | Haug | 407/28 |
| 5,249,485 | 10/1993 | Hayden, Sr. | 76/112 |

*Primary Examiner*—W. Donald Bray
*Attorney, Agent, or Firm*—Burns, Doane, Swecker & Mathis, L.L.P.

[57] ABSTRACT

A method for improving the endurance of a blade base (6) of the disc (1) of a disc chipper, a blade base and a disc chipper. A wearing plate (10) is attached to the surface (18) of the blade base facing towards the chip opening (7), the wearing surface (10) of which is shot peened.

20 Claims, 4 Drawing Sheets

PRIOR ART

METHOD FOR IMPROVING THE ENDURANCE OF A BLADE BASE OF A DISC CHIPPER, A BLADE BASE OF A DISC CHIPPER AND A DISC CHIPPER

The present invention concerns a method, a blade base and a disc chipper in accordance with the preamble of claims 1, 4 and 10.

Disc chippers are generally used in the wood processing industry for chipping wood prior to further processing. Some known chipper discs have been described in patent publications FI 74901 and FI 79799. Blades are attached, evenly divided, to a rotating disc of a chipper, said blades cutting chips from a tree trunk against a fixed counter blade. The chips exit in the rotating direction of the disc through a chip opening in the front side of the blade. After the blade has removed the chips from the wood, they collide in the chip opening against the blade base, from where they bounce and go on along the chip opening to the back side of the blade disc. The side of the blade base, against which the chips collide, is exposed to wearing.

The most general solution presently used is to arrange a changeable blade stopper between the blade base and the blade. A blade base made of two pieces is, however, weak, especially when using a small edge angle of the blade base.

An object of the present invention is to make the side of the blade base facing towards the chip opening a solid, robust part and more wear resistant.

Shot peening is one known cold working method of metal, dealt with e.g. in publication Peening Reference Manual 1991 and in issue No 11, 1992 of Konepajamies, a publication of VTT, the Technical Research Center of the Finnish state.

Characteristics of the present invention have been stated in claims 1, 4 and 10.

Figure 1:
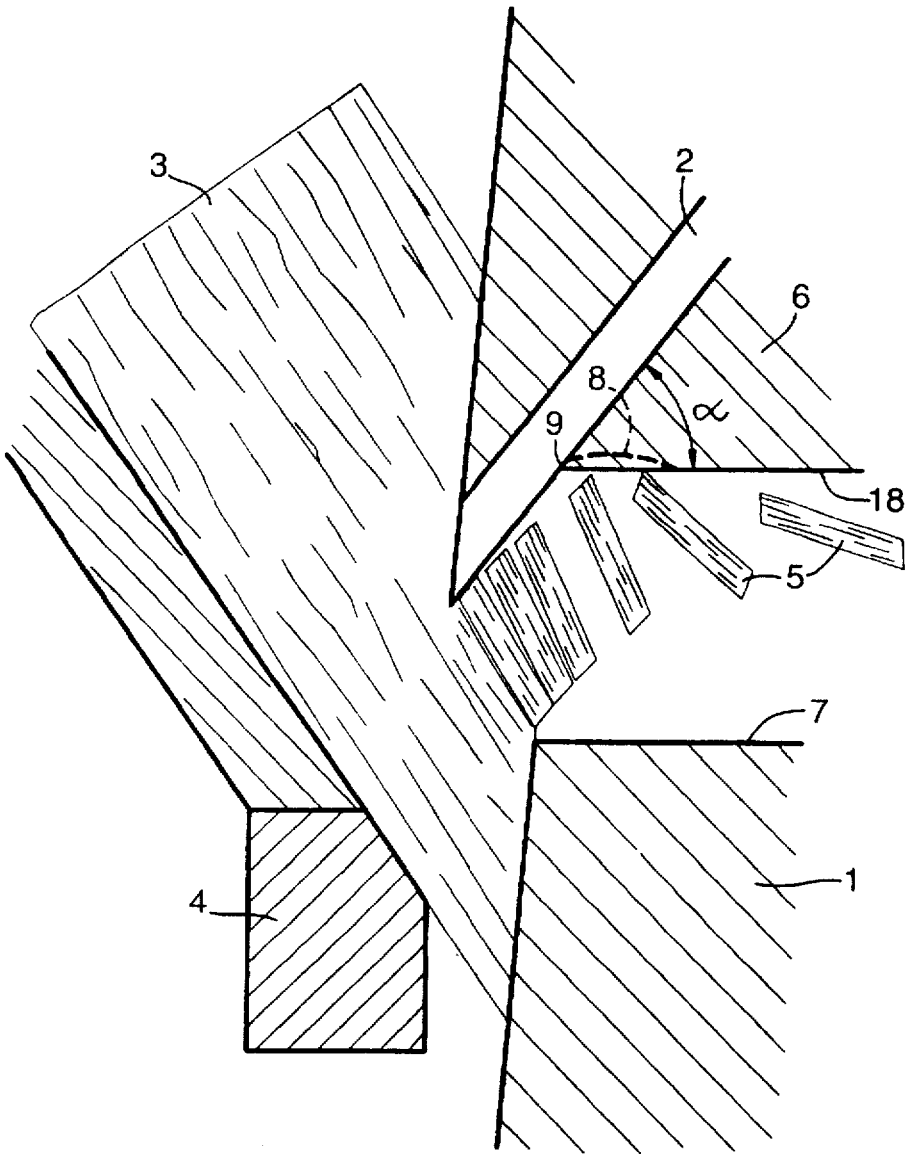
Figure 3:
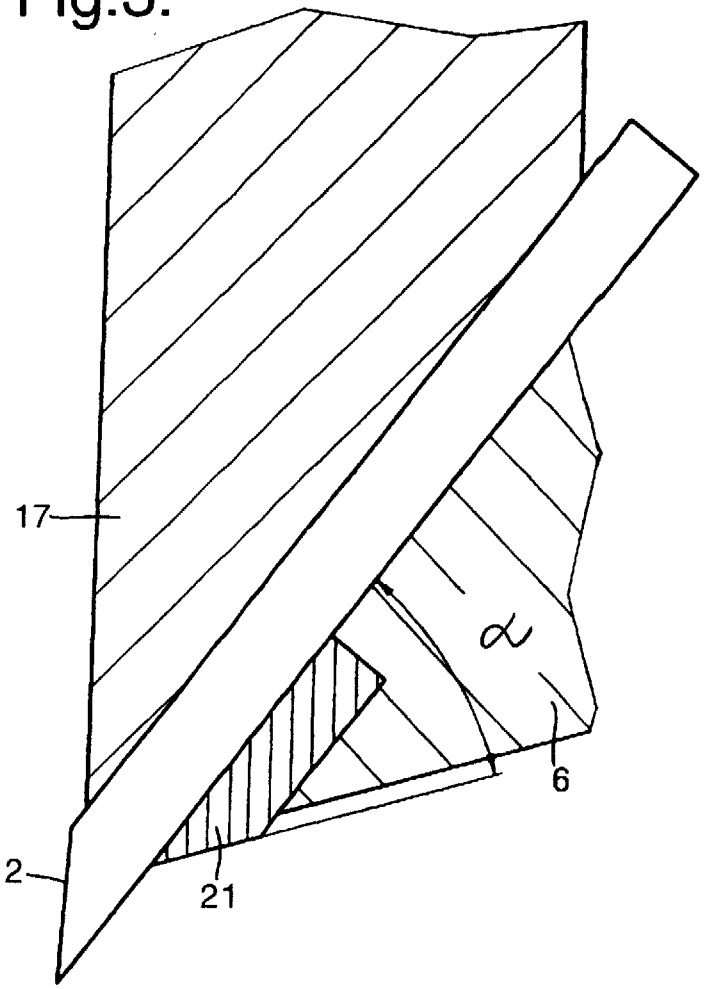
Figure 2:
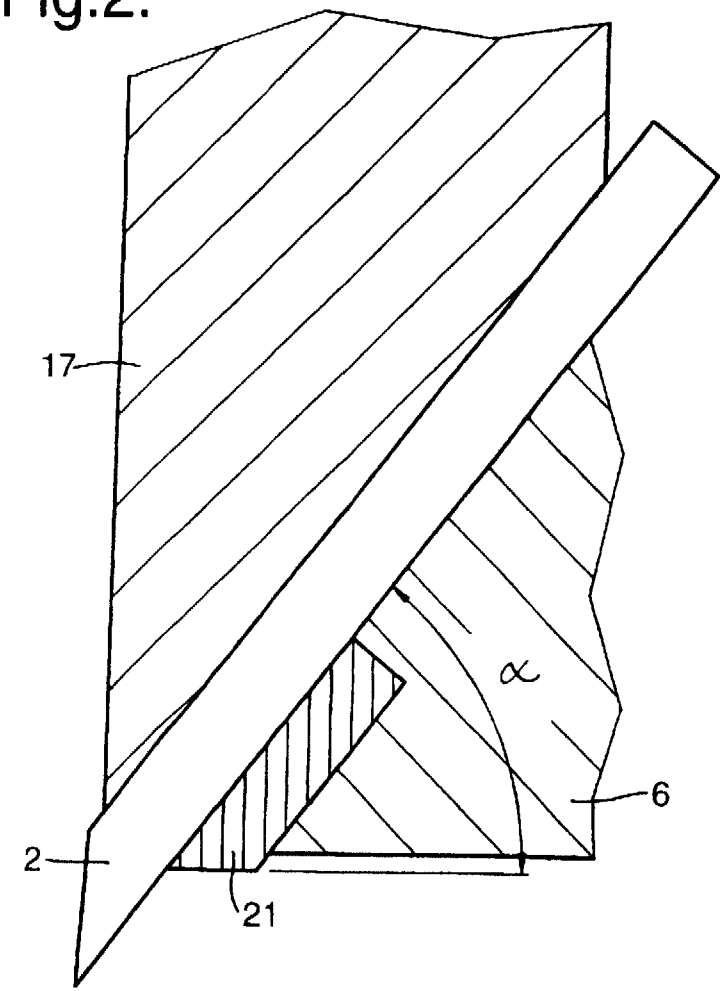
Figure 5:
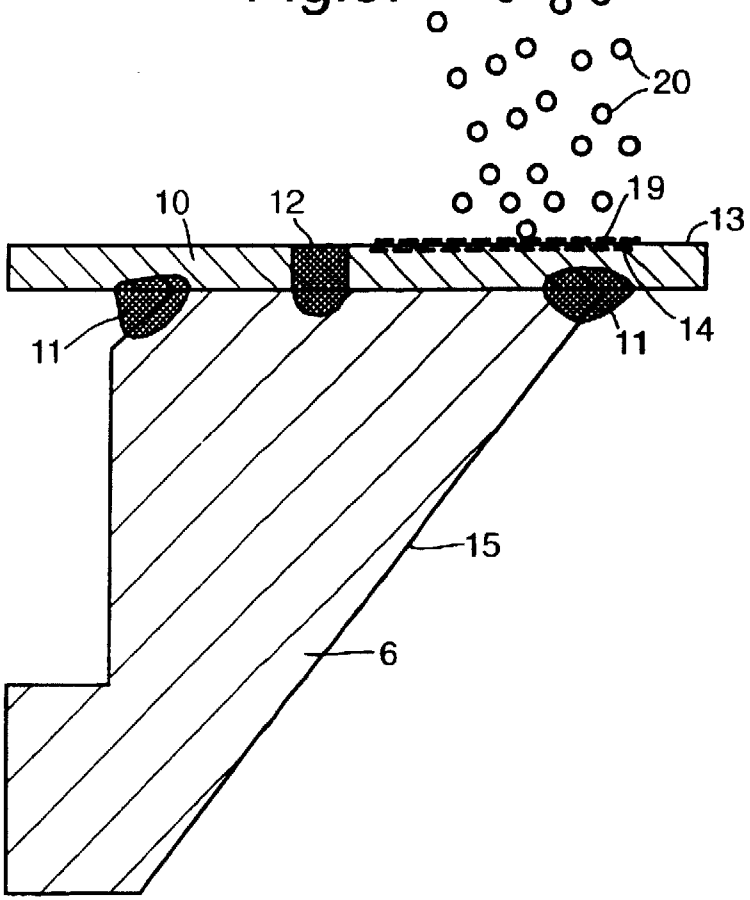
Figure 4:
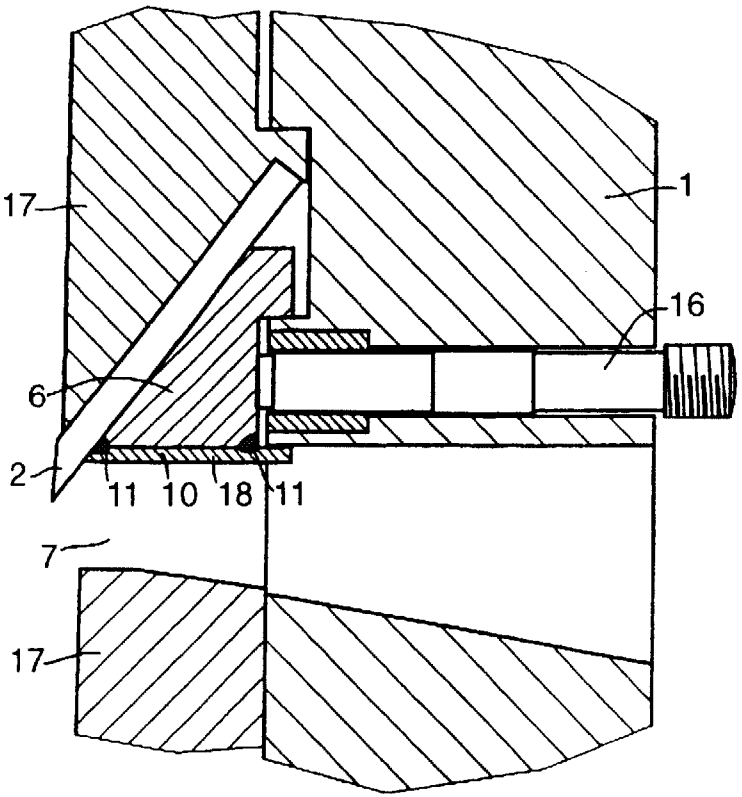
Figure 7:
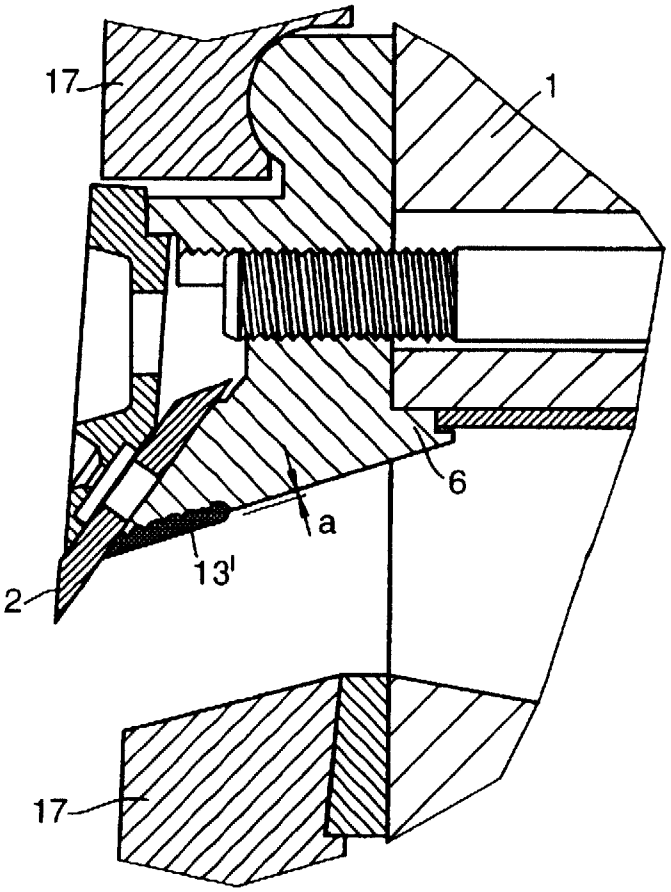
Figure 6:
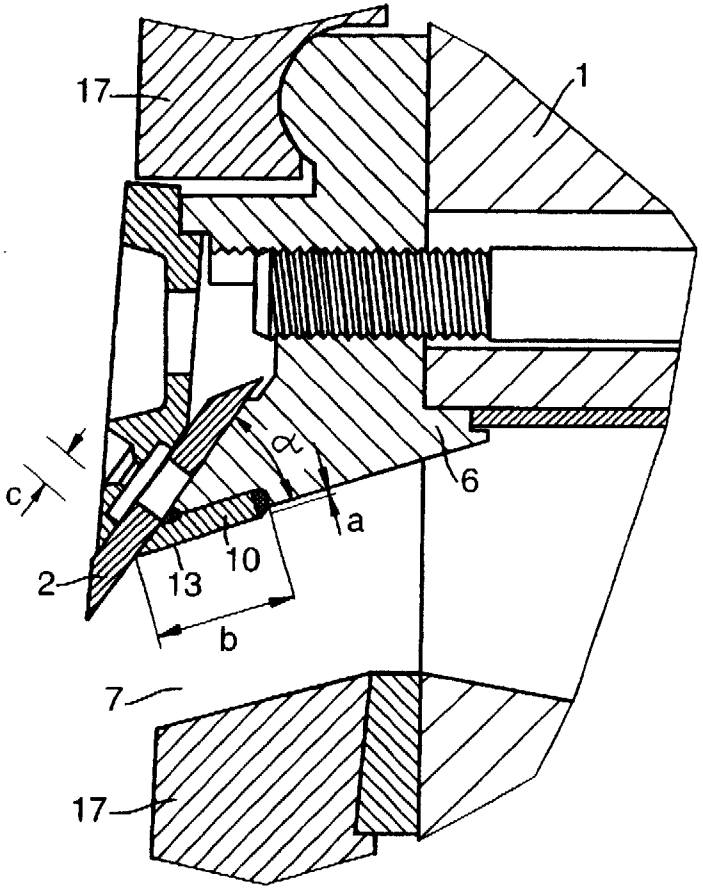

The present invention and its details are described in more detail in the following, with reference to the enclosed drawings, wherein FIG. 1 shows a side elevation of wood chipping in a disc chipper, FIG. 2 shows a side elevation of a blade and a blade base of a disc chipper, FIG. 3 shows a side elevation of a disc chipper and an other type of a blade base, FIG. 4 shows a side elevation of a disc of a disc chipper and a blade base in accordance with the invention in a traditional blade system with clamping attachment, FIG. 5 shows in an enlarged scale a section of a blade base in accordance with the invention, FIG. 6 shows a side elevation of a disc of a disc chipper and a blade base in accordance with the invention in a new type of a blade system, and FIG. 7 illustrates an alternative embodiment.

In FIG. 1, the blade 2 of a rotating blade disc 1 of a chipper chips wood 3 against a fixed counter blade 4. After the blade 2 has removed the chips 5, they collide against a blade base 6, after which they exit through a chip opening 7 between the blade base 6 and a wearing plate 17 of the disc, said chip opening extending through the disc. The chips 5 colliding against the blade base 6 wear the blade base forming thereby rapidly a pit 8 in the surface 18 facing towards the chip opening, marked with the dashed line. An other problem appears, when the point 9 of the blade base that is against the blade wears, whereby the sticks of the wood enter between the blade 2 and the blade base 6.

It is shown by tests that a small edge angle of the blade base decreases formation of sawdust and sticks and improves the quality of chips. A problem is the production of a wear resistant and robust sharp point 9 of the blade base.

One method being used for preventing the rapid wearing of the blade base is described in FIG. 2. A separate wearing part, a blade stopper 21, has been attached to the blade base under the blade 2 adjacent to the chip opening. The normal edge angle $\alpha$ of the blade base and the blade stopper is presently about 55°. When the blade stopper wears it is replaced by a new one so that it is not necessary to chance the whole blade base 6. The blade stopper is attached with bolts to the blade base. The method deteriorates the solidity of the whole blade system and increases the number of parts of the blade system. Especially the solidity would be deteriorated in a new type of a blade system according to FIG. 3, improving the chip quality, in which the edge angle $\alpha$ of the blade base between the blade and the edge of the chip opening is less than 40°.

FIG. 4 illustrates a blade base in accordance with the present invention, decreasing the wearing. The wearing surface 18 of the blade base 6, facing towards the chip opening 7, is provided with a wear resistant chromiferous wearing plate 10. The wearing plate 10 of the blade base, made of austenitic, about 200 HB hard acid resistant steel, has been welded at its both edges with welds 11 and at its middle part with plug welds 12 to the frame of the blade base 6. The machined blade base 6 presses the blade 2 by means of a bolt 16 against the wearing plate 17 of the blade disc in a conventional blade system with clamping attachment.

FIG. 5 illustrates, how the wearing surface 13 of the wearing plate 10 is shot peened 20, whereby the wearing surface 13 hardens into a wear resistant layer 14 up to a depth of about 0.5–1.0 mm and a hardness of about 400–500 HB. After the shot peening, the surface 15 of the blade base 6 facing towards the blade and the side of the wearing plate 10 are machined in order to get the side of the wearing plate and the blade base to the same level for fixing the blade.

The wearing plate of the blade base in accordance with the invention can also be attached to a new type of a blade system, where the edge angle $\alpha$ of the blade base is smaller than 40° (FIG. 6), whereby a recess is made for the wearing plate 10 to the blade base 6 on the surface facing towards the chip opening, to the edge that is against the blade. The method can also be used as a corrective measure for old blade bases. The wearing plate 10 is fixed only to a portion, where wearing appears. When the wearing surface 13 of the wearing plate, measured as the dimension a, is higher than the surface 18 of the blade base, the chip does not wear significantly the blade base surface 18 for the portion after the wearing plate. 10.

The part of the point of the blade base 6, said part corresponding to the wearing plate 10, in accordance with the invention, can also be formed by welding with an austenitic welding rod (FIG. 7). After that the welded surface 13' of the point of the blade base is machined and then shot peened, as shown in FIG. 5.

Both the wearing plate 10 in the embodiments of FIG. 4 and FIG. 6, and the welded surface 13' in the embodiment of FIG. 7 are, however, such that their dimension b in the direction of the depth of the wall of the chip opening 7 is bigger than their dimension c in the direction of the width of the side of the blade 2.

The abrasion resistance can be improved still after the shot peening 20, when the surface 13 or the welded surface 13' of the wearing plate is coated with an especially hard tungsten carbide 19 (FIG. 5) or with some other cold coating method. With cold coating it is meant a coating method, whereby the temperature of the surface to be coated does not rise so much that the influence of the shot peening would become weaker.

We claim:

1. A method for increasing endurance of a blade base of a disc of a disc chipper comprising the steps of:

attaching a wearing part to a blade base of a disc of a disc chipper so that a wearing surface of the wearing part faces toward a chip opening of the blade base: and shot peening the wearing surface so that abrasion resistance of the wearing surface is increased.

2. A method in accordance with claim 1, wherein the wearing part is attached to the blade base by welding and the wearing surface is shot peened after the welding.

3. A method in accordance with claim 1, comprising the further step of coating the shot peened wearing surface with tungsten carbide.

4. A blade base of a disc chipper for attaching a blade to a disc, comprising:

a frame, the frame having a surface; and a wearing part attached to the surface, the wearing part having a wearing surface, the wearing surface being shot peened such that wear resistance of the wearing surface is increased relative to wear resistance of a remaining portion of the wearing part.

5. A blade base in accordance with claim 4, wherein a dimension of the wearing part in a direction of a depth of the chip opening is bigger than a dimension of the wearing part in a direction of a width of a side of a blade to be attached to a disc of a disc chipper on the blade base.

6. A blade base in accordance with claim 4, wherein a dimension of the wearing part in a direction of a depth of the chip opening covers the surface.

7. A blade base in accordance with claim 4, wherein a dimension of the wearing part in a direction of a depth of the chip opening covers an edge of the surface.

8. A blade base in accordance with claim 4, wherein the wearing part is made of austenitic steel.

9. A blade base in accordance with claim 4, wherein an edge angle of the blade base is smaller than 40°.

10. A method in accordance with claim 2, comprising the further step of coating the shot peened wearing surface with tungsten carbide.

11. A blade base in accordance with claim 5, wherein the dimension of the wearing part in the direction of the depth of the chip opening covers the surface.

12. A blade base in accordance with claim 5, wherein the dimension of the wearing part in the direction of the depth of the chip opening covers an edge of the surface.

13. A blade base in accordance with claim 5, wherein the wearing part is made of austenitic steel.

14. A blade base in accordance with claim 6, wherein the wearing part is made of austenitic steel.

15. A blade base in accordance with claim 7, wherein the wearing part is made of austenitic steel.

16. A blade base in accordance with claim 5, wherein an edge angle of the blade base is smaller than 40°.

17. A blade base in accordance with claim 6, wherein an edge angle of the blade base is smaller than 40°.

18. A blade base in accordance with claim 7, wherein an edge angle of the blade base is smaller than 40°.

19. A blade base in accordance with claim 8, wherein an edge angle of the blade base is smaller than 40°.

20. A disc chipper, comprising:

a fixed counter blade;

a rotatable disc, the rotatable disc being rotatable relative to the fixed counter blade, the rotatable disc including at least one blade base for attaching at least one blade to the rotatable disc, and at least one wearing plate, the at least one blade base and the at least one wearing plate defining a chip opening, the at least one blade base including a frame and a wearing part attached to a surface of the frame, the wearing part having a wearing surface, the wearing surface facing toward the chip opening, the wearing surface being shot peened such that it has a greater abrasion resistance than a remaining portion of the wearing part.

* * * * *